US011130351B2

(12) United States Patent
Yoshikawa

(10) Patent No.: US 11,130,351 B2
(45) Date of Patent: Sep. 28, 2021

(54) CONTROL INFORMATION GENERATING METHOD, CONTROL INFORMATION GENERATING APPARATUS, AND THERMAL TRANSFER APPARATUS

(71) Applicant: SEIKO EPSON CORPORATION, Tokyo (JP)

(72) Inventor: Eishin Yoshikawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/005,924

(22) Filed: Jun. 12, 2018

(65) Prior Publication Data

US 2018/0361756 A1 Dec. 20, 2018

(30) Foreign Application Priority Data

Jun. 14, 2017 (JP) ..... JP2017-116544

(51) Int. Cl.

| | |
|---|---|
| ***B41J 2/33*** | (2006.01) |
| ***B41J 2/005*** | (2006.01) |
| ***B41J 2/335*** | (2006.01) |
| ***B41J 2/01*** | (2006.01) |
| ***B41J 2/325*** | (2006.01) |

(52) U.S. Cl.

CPC ..... *B41J 2/33* (2013.01); *B41J 2/0057* (2013.01); *B41J 2/01* (2013.01); *B41J 2/325* (2013.01); *B41J 2/33545* (2013.01); *B41J 2002/012* (2013.01)

(58) Field of Classification Search

CPC .. B41F 16/00; B41F 16/0006; B41F 16/0026; B41F 16/0033; B41J 2/315; B41J 2/33; B41J 2/33545; B41J 2/0057; B41J 2002/012; B41J 2/32; B41J 2/325; B41J 2/01

See application file for complete search history.

(56) References Cited

U.S. PATENT DOCUMENTS

| | | | | |
|---|---|---|---|---|
| 5,946,020 | A * | 8/1999 | Rogers | B41J 2/325 347/191 |
| 2003/0007061 | A1 | 1/2003 | Ogawa | |
| 2011/0001772 | A1 * | 1/2011 | Sakurai | B41J 2/17566 347/7 |
| 2016/0114593 | A1 | 4/2016 | Ume | |

FOREIGN PATENT DOCUMENTS

| | | | |
|---|---|---|---|
| JP | 06-008489 | A | 1/1994 |
| JP | 2003-001814 | A | 1/2003 |
| JP | 2006-321056 | A | 11/2006 |
| JP | 2006-322077 | A | 11/2006 |
| JP | 2007-072022 | A | 3/2007 |
| JP | 2016-083792 | A | 5/2016 |

* cited by examiner

*Primary Examiner* — Kristal Feggins

(74) *Attorney, Agent, or Firm* — Global IP Counselors, LLP

(57) ABSTRACT

A control information generating method includes generating thermal transfer control information based on an amount of ink to be used for printing of a printing medium, in a case where thermal transfer control information for heating a printing medium printed on a first medium based on image data and thermally transferring the printing medium to a second medium is generated.

21 Claims, 9 Drawing Sheets

FIG. 5A

LINE IMAGE

51

| AMOUNT OF INK [%] (DRAWING AREA/REGION AREA) | HEATING CONDITION | | |
|---|---|---|---|
| | TRANSFER TEMPERATURE [DEG] | TRANSFER TIME [sec] | |
| | | MEDIA A | MEDIA B |
| 10 | 180 | 120 | 100 |
| 20 | 180 | 140 | 120 |
| 30 | 180 | 160 | 140 |
| 40 | 190 | 180 | 160 |
| 50 | 190 | 200 | 180 |
| 60 | 200 | 200 | 180 |
| 70 | 200 | 200 | 180 |
| 80 | 210 | 200 | 180 |
| 90 | 210 | 200 | 180 |
| 100 | — | — | — |

FIG. 5B

SOLID IMAGE

52

| AMOUNT OF INK [%] (DRAWING AREA/REGION AREA) | HEATING CONDITION | | |
|---|---|---|---|
| | TRANSFER TEMPERATURE [DEG] | TRANSFER TIME [sec] | |
| | | MEDIA A | MEDIA B |
| 10 | 200 | 110 | 90 |
| 20 | 200 | 130 | 110 |
| 30 | 200 | 150 | 130 |
| 40 | 200 | 170 | 150 |
| 50 | 210 | 180 | 160 |
| 60 | 210 | 180 | 160 |
| 70 | 210 | 180 | 160 |
| 80 | 220 | 190 | 170 |
| 90 | 220 | 190 | 170 |
| 100 | 220 | 190 | 170 |

FIG. 6

61

| REGION | HEATING CONDITION | | |
|---|---|---|---|
| | TRANSFER TEMPERATURE [DEG] | TRANSFER TIME [sec] | |
| a | 180 | 120 | • • • LINE IMAGE + INK AMOUNT 10% |
| b | 180 | 160 | • • • LINE IMAGE + INK AMOUNT 30% |
| c | — | — | |
| d | — | — | |
| e | 220 | 190 | • • • SOLID IMAGE + INK AMOUNT 80% |
| f | 210 | 180 | • • • SOLID IMAGE + INK AMOUNT 60% |
| g | — | — | |
| h | — | — | |

62

| REGION | HEATING CONDITION | | |
|---|---|---|---|
| | TRANSFER TEMPERATURE [DEG] | TRANSFER TIME [sec] | |
| a | 180 | 120 | • • • LINE IMAGE + INK AMOUNT 10% |
| b | 180 | 160 | • • • LINE IMAGE + INK AMOUNT 30% |
| c | — | — | |
| d | — | — | |
| e | 210 | 200 | • • • SOLID IMAGE + INK AMOUNT 80% |
| f | 210 | 180 | • • • SOLID IMAGE + INK AMOUNT 60% |
| g | — | — | |
| h | — | — | |

CONTROL INFORMATION GENERATING METHOD, CONTROL INFORMATION GENERATING APPARATUS, AND THERMAL TRANSFER APPARATUS

BACKGROUND

1. Technical Field

The present invention relates to a control information generating method for generating thermal transfer control information for thermally transferring a printing medium printed on a first medium to a second medium, a control information generating apparatus for generating thermal transfer control information, and a thermal transfer apparatus for performing a thermal transfer based on thermal transfer control information.

2. Related Art

In recent years, there is known a printing method of printing a pattern, a design or the like on a recording medium by utilizing the thermal transfer (sublimation transfer) of ink (for example, JP-A-2006-322077). In such a printing method using the thermal transfer, a sublimation type ink (disperse dye ink) is mirror-image-printed (horizontally reversed) on a thermal transfer paper (an example of the first medium) by an ink jet printer or the like. Thereafter, the printed surface of the thermal transfer paper is aligned with the transferred surface of a recording medium (an example of a second medium) such as polyester fiber, and thermal pressurization is applied to the printed surface by a thermal transfer apparatus (heat press machine), and thus sublimated (vaporized) ink enters the molecular structure of the recording medium and is dyed. According to such a printing method using the thermal transfer, there is no need for a printing plate, and effects such as full color and ease of gradation correspondence are obtained.

As described above, in the thermal transfer, the printing medium printed on the first medium is transferred to the second medium by application of heat and pressure using the thermal transfer apparatus. At this time, in the thermal transfer apparatus, a heating temperature, a heating time, a pressurizing force and the like are controlled under conditions suitable for the thermal transfer. However, in a case where the printing medium printed on the first medium is an image of drawing content in which there is shading in printing or a mixture of a line image and a solid image, it becomes difficult to set conditions suitable for the thermal transfer. This is due to the thermal transfer utilizing sublimation of ink. In other words, since ink spreads in the planar direction of the first medium as the ink is sublimated (vaporized), the ink particles having the first medium printed thereon are fixed to the second medium in a state of being spread by sublimation. In a case where the heating is excessive, the color of the ink changes. At this time, the condition of ink spreading, or the condition of discoloration differ depending on the amount of ink to be used for printing and the amount of heating during the thermal transfer. For that reason, in order for the original printing medium to be thermally transferred faithfully, it is preferable that the amount of heating be appropriately controlled according to the amount of ink. On the other hand, in a case where an elaborate printing medium using different amount of ink is thermally transferred under a single condition, the color from the original printing medium changes or the contour becomes blurred due to spreading of the ink, and thus there is a possibility that a problem that the original printing medium may not be thermally transferred faithfully will occur. However, there has not yet been proposed a technique of determining conditions suitable for the thermal transfer according to the drawing content of the printing medium and performing the thermal transfer.

SUMMARY

An advantage of some aspects of the invention is to provide a control information generating method for generating thermal transfer control information according to the drawing content of a printing medium in a case where the printing medium printed on a first medium is thermally transferred to a second medium, a control information generating apparatus for generating the thermal transfer control information, and a thermal transfer apparatus for performing the thermal transfer based on the thermal transfer control information.

The invention can be realized in the following aspects or application examples.

In this specification, an image is a figure drawn by characters, graphics, or the like, and image data are digitized by associating the image with two-dimensional coordinates, and are data indicating an ink color and an amount of ink to be used by the printing apparatus to form a printing medium on a medium. The printing medium is an image formed on the medium by the printing apparatus based on the image data.

Application Example 1

According to the application example, there is provided a control information generating method for generating thermal transfer control information for heating a printing medium printed on a first medium based on image data and thermally transferring the printing medium to a second medium, in which the thermal transfer control information is generated based on the amount of ink to be used for printing of the printing medium.

In this configuration, the thermal transfer control information for thermally transferring the printing medium is generated based on the amount of ink to be used for printing of the printing medium. For that reason, the thermal transfer conditions are appropriately set according to the amount of ink, and the printing medium is thermally transferred faithfully.

Application Example 2

In the application example, it is preferable that, in correspondence with the amount of ink in a predetermined region of the printing medium, a heating condition for heating the printing medium in the region be determined, and thermal transfer control information include the heating condition.

In this configuration, in correspondence with the amount of ink for each predetermined region, the heating condition for heating the region is determined. For that reason, the amount of heating is appropriately controlled according to the amount of ink for each region of the printing medium, and the printing medium is thermally transferred faithfully.

Application Example 3

In the application example, it is preferable to determine the heating condition based on the correspondence table in which an amount of ink and a heating condition are associated.

In this configuration, the heating condition is determined based on the correspondence table showing the correlation between the amount of ink and the heating condition. For that reason, the corresponding heating condition may be quickly derived from the amount of ink. Further, it is possible to easily change the heating condition by rewriting the correspondence table.

Application Example 4

In the application example, it is preferable that the correspondence table be switched according to the drawing content of the printing medium.

In this configuration, the correspondence table is switched according to the drawing content of the printing medium. For that reason, the heating condition is determined by the correspondence table suitable for the drawing content. As a result, the printing medium is thermally transferred faithfully.

Application Example 5

In the application example, it is preferable that the heating condition be determined based on a calculation formula for calculating the heating condition from the amount of ink.

In this configuration, the heating condition is calculated from the amount of ink using a calculation formula. For that reason, as compared with the correspondence table, it is possible to derive the heating condition corresponding to a finer difference in the amount of ink. Since a storage capacity necessary for storing the calculation formula may be reduced as compared with a storage capacity necessary for storing the correspondence table, a storage region (storage capacity) may be saved.

Application Example 6

In the application example, it is preferable that the calculation formula be switched according to the drawing content of the printing medium.

In this configuration, the calculation formula is switched according to the drawing content of the printing medium. For that reason, the heating condition is determined by a calculation formula suitable for the drawing content. As a result, the printing medium is thermally transferred faithfully.

Application Example 7

In the application example, it is preferable that the heating condition be determined such that a difference between the heating temperatures of the adjacent regions falls within a predetermined value.

In this configuration, heating condition is determined such that a temperature difference exceeding a predetermined value does not occur between adjacent (continuous) regions of the printing medium. Therefore, since regions in contact with each other without waiting for an adiabatic region are not heated with a temperature difference exceeding a predetermined value, the occurrence of a sharp temperature gradient between the regions is suppressed so that the inside of the regions is heated to an accurate temperature on average.

Application Example 8

In the application example, it is preferable that the heating condition include a heating temperature and a heating time for heating the printing medium.

In this configuration, the heating condition includes a heating temperature and a heating time. For that reason, it is possible to control heating of the printing medium with the temperature and the time.

Application Example 9

In the application example, in the case where the printing medium is thermally transferred while the second medium is transported, it is preferable to include a transport speed of the second medium in the heating condition.

In this configuration, the transport speed of the second medium to which the printing medium is thermally transferred is included in the heating condition.

For that reason, in a case where the thermal transfer apparatus is a transport type thermal transfer apparatus (for example, a rotary thermal transfer apparatus), it is possible to manage the heating time by the transport speed of the second medium.

Application Example 10

According to the application example, there is provided a control information generating apparatus that generates thermal transfer control information for heating a printing medium printed on a first medium based on image data and thermally transferring the printing medium to a second medium, the apparatus including: a thermal transfer control information generating portion that generates the thermal transfer control information based on the amount of ink to be used for printing of the printing medium, using the control information generating method according to a first aspect to an eighth aspect of the invention.

In this configuration, the control information generating apparatus includes the thermal transfer control information generating portion, and may generate the thermal transfer control information based on the amount of ink to be used for printing of the printing medium. For that reason, the thermal transfer conditions are appropriately set according to the amount of ink, and the printing medium is thermally transferred faithfully.

Application Example 11

In the application example, it is preferable that the control information generating apparatus output the thermal transfer control information to a printing apparatus that prints the printing medium.

In this configuration, the control information generating apparatus may output the generated thermal transfer control information to the printing apparatus. Therefore, an operator of a thermal transfer system may print and confirm the thermal transfer control information.

Application Example 12

According to the application example, there is provided a thermal transfer apparatus that heats a printing medium printed on a first medium based on image data and thermally transfers the printing medium to a second medium, the thermal transfer apparatus including: a plurality of heating portions for heating the printing medium, in which the plurality of heating portions are individually heated based on thermal transfer control information that is determined according to an amount of ink to be used for printing of a predetermined region of the printing medium.

In this configuration, the thermal transfer apparatus may heat the printing medium by individually controlling the plurality of heating portions based on the thermal transfer control information. Therefore, since the predetermined region may be accurately heated according to the amount of ink, the printing medium is thermally transferred faithfully.

BRIEF DESCRIPTION OF THE DRAWINGS

The invention will be described with reference to the accompanying drawings, wherein like numbers reference like elements.

FIG. 5A is an example of a line image correspondence table.

FIG. 5B is an example of a solid image correspondence table.

FIG. 6 is an example of thermal transfer control information.

DESCRIPTION OF EXEMPLARY EMBODIMENTS

Embodiment

Figure 1:
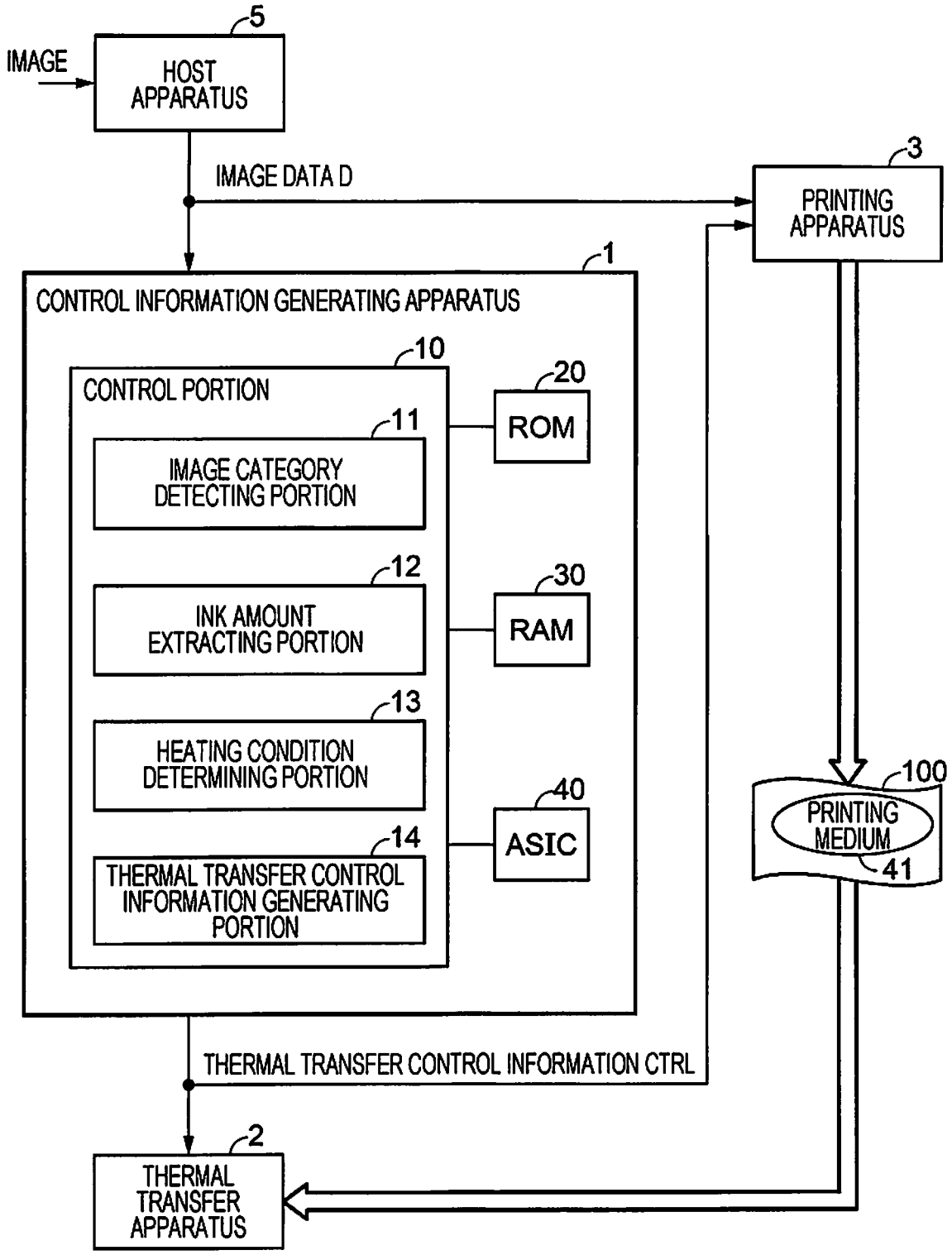
FIG. 1 is a diagram showing a configuration of a thermal transfer system.

Hereinafter, an embodiment of a control information generating method to which the invention is applied will be described with reference to the drawings. In the present embodiment, a thermal transfer system including a control information generating apparatus 1 for generating thermal transfer control information CTRL based on the control information generating method, a thermal transfer apparatus 2 for performing the thermal transfer based on the generated thermal transfer control information, a printing medium 41, and a printing apparatus 3 for printing the thermal transfer control information CTRL will be described as an example.

In the drawings referred to in the following description, for the sake of convenience of description and illustration, the vertical and horizontal scales of the members or parts may be represented differently from the actual ones. The illustration of components other than components necessary for description may be omitted.

Thermal Transfer System

FIG. 1 is a diagram showing a thermal transfer system including a control information generating apparatus 1, a thermal transfer apparatus 2, and a printing apparatus 3.

The host apparatus 5 is an information processing apparatus (PC or the like), and stores data (image data D) of an image captured by, for example, a camera, a scanner or the like, or image data D transmitted from another information processing apparatus and selects the image data D to be printed by thermal transfer from among the stored image data D. The selected image data D is converted into image data D in a format for printing by a printer driver provided in the host apparatus 5, and are output to the control information generating apparatus 1 and the printing apparatus 3.

The stored image data D is, for example, data in a format conforming to a graphics device interface (GDI), and the color of the pixel corresponding to the two-dimensional coordinates of the image is multi-value and expressed in (for example, 256 gradations from 0 to 255) of red-green-blue (RGB). Based on a color conversion table, that is, a look up table (LUT) hold by the printer driver, the image data D which are expressed in the RGB are converted into image data D for printing, which are represented by four components of cyan-magenta-yellow-black (CMYK) of the ink color of the printing apparatus 3 and the amount of ink of the CMYK, and are output to the control information generating apparatus 1 and the printing apparatus 3. The LUT is a conversion table for converting the image data D, which are expressed and stored in RGB, into image data D for printing, which is expressed in the ink color of CMYK and the amount of ink of the CMYK.

The printing apparatus 3 is an ink jet printer that prints a printing medium 41 (see FIGS. 4A and 4B) on thermal transfer paper 100 by discharging sublimation type ink toward thermal transfer paper 100 (an example of a first medium). On the printing apparatus 3, a liquid container storing sublimation type ink is mounted. The sublimation type ink is a liquid (color ink) containing a coloring material such as a dye. For example, the sublimation type ink of a total of four colors of cyan (C), magenta (M), yellow (Y), and black (K) is stored in the liquid container. The printing apparatus 3 further includes a transport mechanism, a movement mechanism, and a print head.

The transport mechanism pinches the thermal transfer paper 100 between a supply roller and a driven roller, which is disposed opposite to the supply roller and a discharge roller, and transports the thermal transfer paper 100 from a position of paper supply to a position of paper discharge. The movement mechanism reciprocates the print head in a direction intersecting (typically orthogonal) to a direction in which the thermal transfer paper 100 is transported. The print head is a liquid discharging mechanism that discharges sublimation type ink supplied from a liquid container toward the thermal transfer paper 100.

Transportation of the thermal transfer paper 100 by the transport mechanism and reciprocating movement of the print head by the movement mechanism are performed and sublimation type ink is discharged from the print head toward the thermal transfer paper 100 so that the printing medium 41 based on the image data D received from host apparatus 5 is printed on the thermal transfer paper 100. Further, the printing apparatus 3 receives the thermal transfer control information CTRL generated by the control information generating apparatus 1, and may print the thermal transfer control information CTRL together with the printing medium 41 on the thermal transfer paper 100.

Figure 3A:
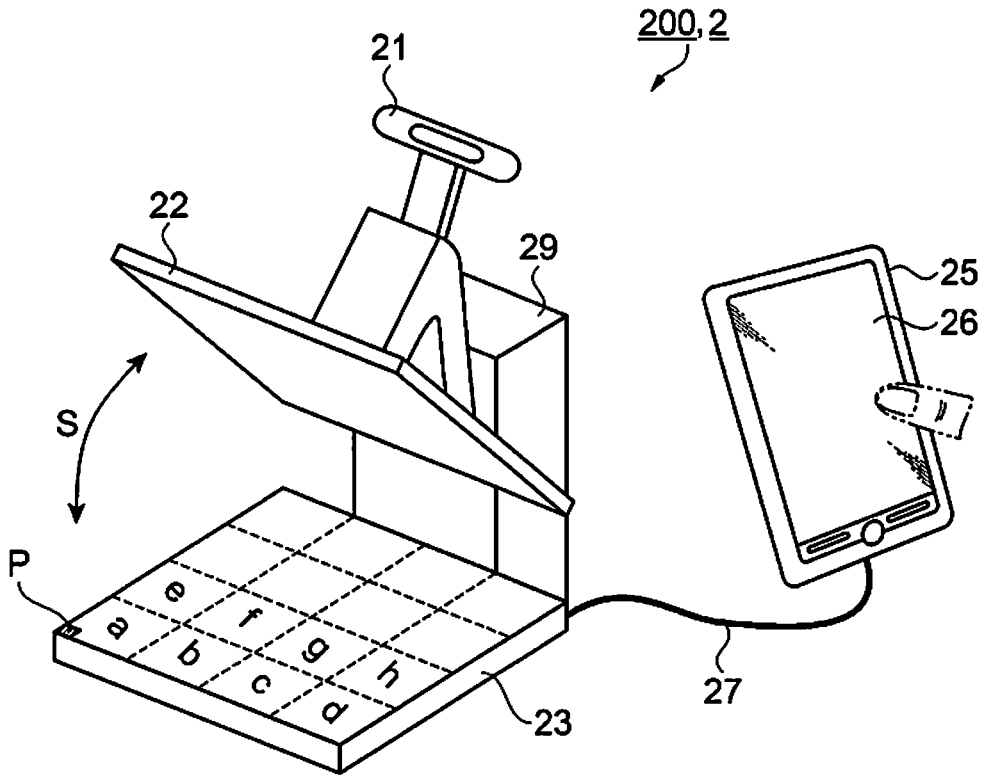
FIG. 3A is an example of a thermal transfer apparatus.
Figure 3B:
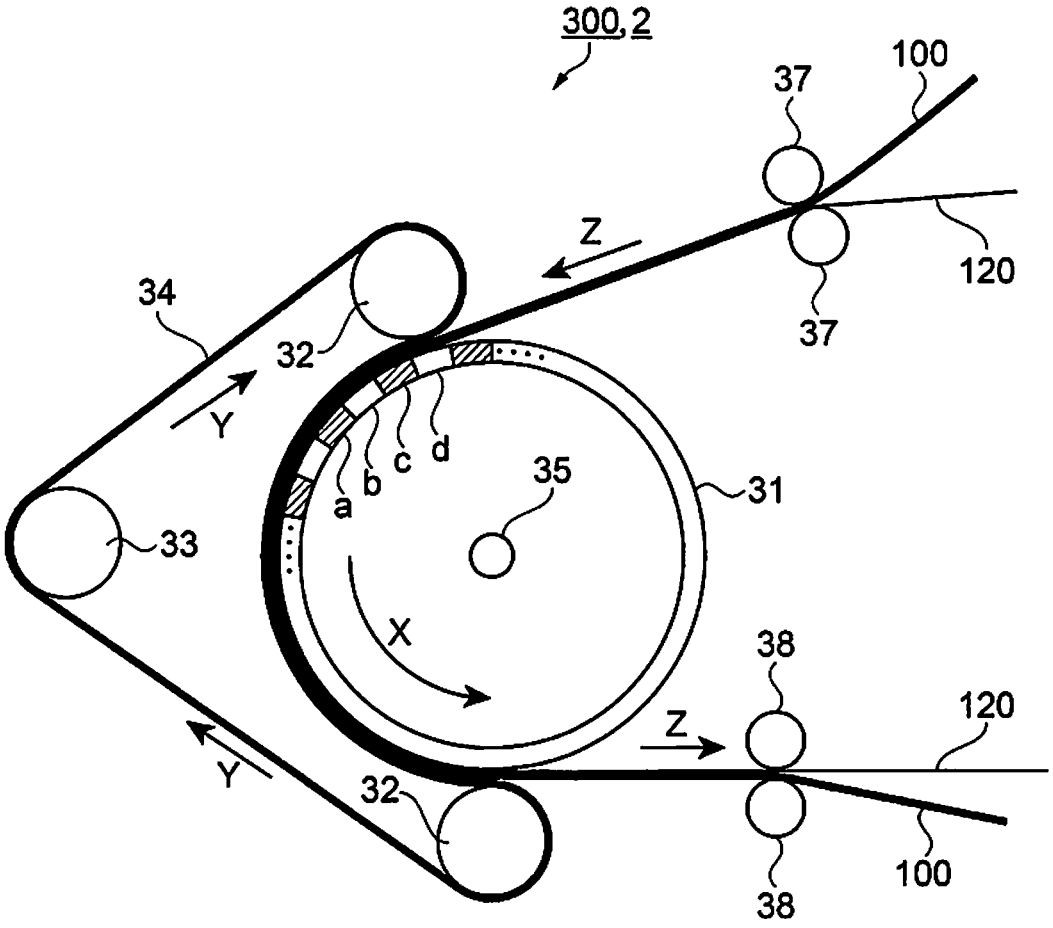
FIG. 3B is another example of a thermal transfer apparatus.

The control information generating apparatus 1 includes a control portion 10, a read only memory (ROM) 20, a random access memory (RAM) 30, and an application specific integrated circuit (ASIC) 40, and generates the thermal transfer control information CTRL for heating the printing medium 41 printed on the thermal transfer paper 100 and thermally transferring the printing medium 41 to the polyester fiber 120 (an example of a second medium, see FIG. 3B). The control portion 10 includes a central processing unit (CPU) and functions in a case where the CPU executes a program stored in the ROM 20. In cooperation with the RAM 30 and the ASIC 40, the control portion 10 generates the thermal transfer control information CTRL based on the image data D received from the host apparatus 5.

More specifically, as shown in FIG. 1, the control portion 10 executes the functions of an image category detecting portion 11, an ink amount extracting portion 12, a heating condition determining portion 13, and a thermal transfer control information generating portion 14. The image category detecting portion 11 judges the drawing content of the printing medium 41 to be printed on the thermal transfer paper 100 from the image data D and categorizes the printing medium according to the drawing content. The ink amount extracting portion 12 calculates the amount of ink in a predetermined region from the image data D. The heating condition determining portion 13 determines a heating condition in the predetermined region based on a correspondence table (described later) in which the amount of ink and the heating condition are associated based on the amount of ink calculated by the ink amount extracting portion 12, or based on a calculation formula (described later) for calculating the heating condition from the amount of ink. The thermal transfer control information generating portion 14 generates thermal transfer control information CTRL for controlling an operating condition of the thermal transfer apparatus 2 based on the heating condition determined by the heating condition determining portion 13 and information specifying a predetermined region. The thermal transfer control information CTRL is transmitted to the thermal transfer apparatus 2 and the printing apparatus 3. In a case where it is unnecessary to print the thermal transfer control information CTRL, the thermal transfer control information CTRL may not be transmitted to the printing apparatus 3.

Here, the predetermined region is a range in which the printing medium 41 is heated during thermal transfer, and is mainly a range that is appropriately determined corresponding to the positions of a plurality of heating portions (described later) provided in the thermal transfer apparatus 2.

In the embodiment, the image category detecting portion 11, the ink amount extracting portion 12, the heating condition determining portion 13, and the thermal transfer control information generating portion 14 are constituted by software in the control portion 10, but each thereof may be constituted by hardware using an electronic element.

The thermal transfer apparatus 2 is an apparatus for performing the thermal transfer (sublimation transfer) of the printing matter printed on the thermal transfer paper 100 to a recording medium (polyester fiber or the like), and in the embodiment, in a state where the thermal transfer paper and the polyester fiber are overlapped, the thermal transfer paper and the polyester fiber is subjected to heat and pressure, and thus the transfer of the printing matter is performed. Based on the thermal transfer control information CTRL generated by the control information generating apparatus 1, the thermal transfer apparatus 2 controls a heating temperature and a heating time suitable for thermal transfer according to the drawing content of the printing medium 41.

Next, in the description of the control of the thermal transfer system, first, the description of each of FIGS. 3A to 6 to be referred to will be proposed.

FIG. 3A shows a handle type thermal transfer apparatus 200 as one form of the thermal transfer apparatus 2. The handle type thermal transfer apparatus 200 includes a heating plate 23 for heating the printing medium 41 printed on the thermal transfer paper 100, a support 29 extending from one end of the heating plate 23 in a direction intersecting the heating plate 23, a pressing plate 22 supported by the support 29 and rotatable toward the heating plate 23, and a handle 21 attached to the pressing plate 22. Further, the handle type thermal transfer apparatus 200 includes a controller 25 for setting the operating condition of the heating plate 23. The controller 25 is, for example, a tablet terminal provided with a touch panel 26, which is connected to the body of the handle type thermal transfer apparatus 200 by a communication cable 27 and controls the operation of the handle type thermal transfer apparatus 200 via the communication cable 27.

The controller 25 controls a heating operation of the handle type thermal transfer apparatus 200 in accordance with thermal transfer control information CTRL input by reading the printed two-dimensional code, the barcode or the like, or thermal transfer control information CTRL input by the user from the touch panel 26, or thermal transfer control information CTRL input from the outside in wireless communication by Bluetooth (registered trademark) or NFC. The pressing plate 22 is rotated in the direction of an arrow Sin the drawing in a case where the handle 21 is operated, and crimps (pressurizes) or releases the thermal transfer paper 100 and the polyester fiber 120 which are overlapped and pinched between the heating plate 23 and the pressing plate 22. The thermal transfer apparatus 2 includes an adjustment mechanism (not shown) that adjusts a force (pressurizing force) to be crimped at the engaging portion between the support 29 and the pressing plate 22. As shown in FIG. 3A, the heating plate 23 has a plurality of regions (a, b, c, and, . . . ), and each region has a heating portion and may be individually controlled in heating. For that reason, on an indication of the controller 25, the heating plate 23 is controlled to heat, for example, a region a at 200 degrees for 200 seconds, a region b at 190 degrees for 180 seconds, and a region e at 180 degrees for 140 seconds.

In the constitution, the handle type thermal transfer apparatus 200 pinches, crimps, and heats the thermal transfer paper 100 and the polyester fiber 120 between the pressing plate 22 and the heating plate 23, and performs thermal transfer of the printing matter printed on the thermal transfer paper 100 to the polyester fiber 120.

FIG. 3B shows a rotary thermal transfer apparatus (transport type thermal transfer apparatus) 300 as another form of the thermal transfer apparatus 2. The rotary thermal transfer apparatus 300 includes a heating drum 31 that rotates around a central axis 35, a pressing roller 32 that crimps the thermal transfer paper 100 and the polyester fiber 120 and wraps a pressing belt 34 around the heating drum 31, and a tension roller 33 for applying tension to the pressing belt 34. Further, the rotary thermal transfer apparatus 300 includes a pair of coupling rollers 37 for overlapping the thermal transfer paper 100 and the polyester fiber 120, and a pair of separating rollers 38 for releasing the overlap of the thermal transfer paper 100 and the polyester fiber 120. Although not shown, the controller 25 is provided similarly to the handle type thermal transfer apparatus 200 (see FIG. 3A).

The outer circumferential surface of the heating drum 31 has a plurality of regions (a, b, c, and, . . . ), and each region has a heating portion and may be individually heated. In FIG. 3B, since the end surface of the heating drum 31 is shown, only the region a, region b, region c and region d are visible, but regions (e, f, g, and, . . . ) in a direction toward back side are arranged, similarly to the heating plate 23 (see FIG. 3A). The heating drum 31 rotates in the direction of an arrow X around the central axis 35, and on the indication of the controller 25, the heating drum 31 is controlled to heat, for example, the region a at 200 degrees for 200 seconds, the region b at 190 degrees for 180 seconds, and the region e at 180 degrees for 140 seconds.

The pressing roller 32 crimps (pressurizes) the thermal transfer paper 100 and the polyester fiber 120 which are overlapped using a pair of coupling rollers 37 and pinched between the pressing roller 32 and the heating drum 31. Further, a pressing belt 34 is bridged over two pressing rollers 32, and the thermal transfer paper 100 and the polyester fiber 120 are crimped (pressurized) by pressure contact of the two pressing rollers 32 and the pressing belt 34, and the heating drum 31. The pressing belt 34 is also bridged over the tension roller 33, and the pressing force is adjusted by moving the position of the tension roller 33 in a far/near direction to the heating drum 31. In accordance with the rotation of the heating drum 31 in the direction of the arrow X, the pressing belt 34 moves in the direction of an arrow Y, and at the same time, the thermal transfer paper 100 and the polyester fiber 120 are transported in the direction of an arrow Z.

In the configuration, while the rotary thermal transfer apparatus 300 heats the thermal transfer paper 100 and the polyester fiber 120 which are pinched and crimped between the two pressing rollers 32 and the pressing belt 34, and the heating drum 31, the rotary thermal transfer apparatus 300 transports the thermal transfer paper 100 and the polyester fiber 120, thereby thermally transferring the printing matter printed on the thermal transfer paper 100 to the polyester fiber 120. The thermal transfer paper 100 and the polyester fiber 120, which are away from the heating drum 31 after the thermal transfer is completed, are separated by a pair of separating rollers 38.

Figure 4A:
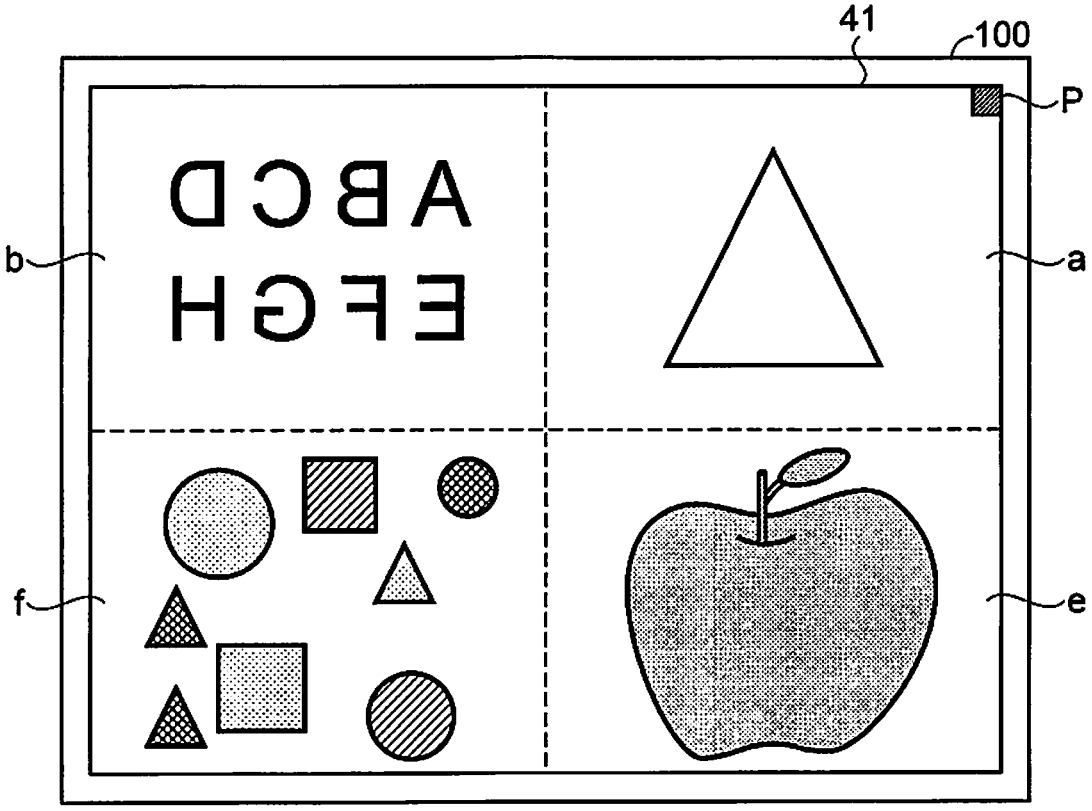
FIG. 4A shows an example of a medium on which a printing medium is printed.

FIG. 4A is an example of the thermal transfer paper (the first medium) 100 on which the printing medium 41 is printed. In a case where a position P is aligned with a position P (see FIG. 3A) of the heating plate 23 of the handle type thermal transfer apparatus 200, the printing medium 41 shown in FIG. 4A is a figure drawn on regions (a, b, e, and f) of the thermal transfer paper 100 corresponding to the regions (a, b, e, and f) of the heating plate 23.

In the printing medium 41, the region a is a triangle (line image) drawn with a line, the region b is a character (line image) drawn with a line, the region e is a painted-out apple (solid image), and the region f is a painted-out graphic (solid image) with different density. Here, the amount of ink to be used for printing of the printing medium 41 is represented by a ratio (drawing area/region area) obtained by dividing the drawing area (area where ink is discharged) by the region area in each region, and assuming that the region a is 10 percent, the region b is 30 percent, the region e is 80 percent, and the region f is 60 percent.

Figure 4B:
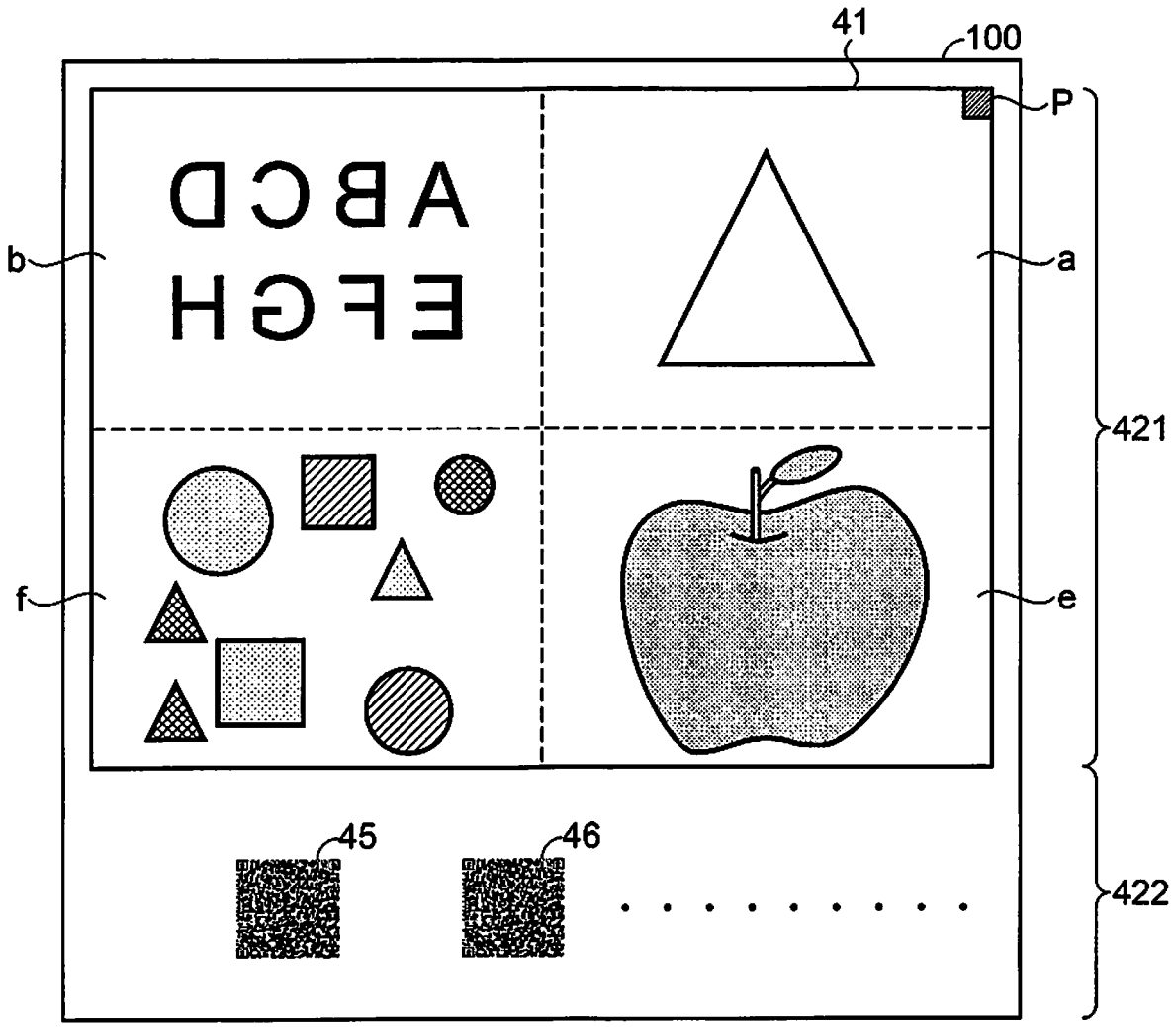
FIG. 4B is another example of a medium on which a printing medium is printed.

FIG. 4B is another example of the thermal transfer paper 100 on which the printing medium 41 is printed. In the thermal transfer paper 100 shown in FIG. 4B, the printing medium 41 to be thermally transferred to the printing medium portion 421 is printed, and two-dimensional codes (45, 46, and, . . . ) are printed in the thermal transfer control information portion 422. In the embodiment, the printing medium 41 is the figure described in FIG. 4A. The two-dimensional codes (45, 46, and, . . . ) is obtained by two-dimensionally coding the thermal transfer control information CTRL for the thermal transfer apparatus 2 at the time of thermally transferring the printing medium 41, and is read by the controller 25 (see FIG. 3A) and set in the thermal transfer apparatus 2.

In the embodiment, even though an example in which a two-dimensional code is printed on the thermal transfer control information portion 422 is shown, thermal transfer control information CTRL may be printed by character information or the like readable by the user, instead of the two-dimensional code. In this case, the user reads the thermal transfer control information CTRL, inputs the thermal transfer control information CTRL to the controller 25, and sets the thermal transfer control information CTRL in the thermal transfer apparatus 2.

FIG. 5A is a correspondence table in which the amount of ink to be used for printing of the printing medium 41 and the heating condition contained in the thermal transfer control information CTRL are associated, and is an example of the line image correspondence table 51. As shown in FIG. 5A, the line image correspondence table 51 shows the relation among the amount of ink represented by the ratio (drawing area/region area), a transfer temperature (degrees, that is Celsius degrees) and a transfer time (secs, that is seconds) suitable for thermal transfer of the printing medium 41 printed with the amount of ink. Further, the transfer time is provided separately (for media A, and for media B) corresponding to the type of thermal transfer paper 100.

Therefore, in a case where the image category detecting portion 11 (see FIG. 1) determines that the printing medium 41 is a line image, the heating condition determining portion 13 (see FIG. 1) may determine the transfer temperature and the transfer time which are heating conditions, based on the amount of ink calculated by the ink amount extracting portion 12 from the line image correspondence table 51.

FIG. 5B is a correspondence table in which the amount of ink and the heating condition are associated similarly to FIG. 5A, and is an example of a solid image correspondence table 52. Therefore, in a case where the image category detecting portion 11 determines that the printing medium 41 is a solid image, the heating condition determining portion 13 may determine the transfer temperature and the transfer time which are heating conditions, based on the amount of ink calculated by the ink amount extracting portion 12 from the solid image correspondence table 52.

The line image correspondence table 51 and the solid image correspondence table 52 are stored in the ROM 20 or the RAM 30 of the control information generating apparatus 1 and may be appropriately rewritten.

FIG. 6 is an example of thermal transfer control information CTRL. The thermal transfer control information table 61 shows the transfer temperature and transfer time corresponding to the regions (a, b, c, and, . . . ) described in FIGS. 3A, 3B, 4A, and 4B. Details will be described later (see FIG. 2), but the thermal transfer control information table 61 is generated by the thermal transfer control information generating portion 14 (see FIG. 1).

The thermal transfer control information table 62 is a table in which the thermal transfer control information table 61 is corrected by the thermal transfer control information generating portion 14. Specifically, the transfer temperature and the transfer time of a half-tone region e in the thermal transfer control information table 62 are corrected. This is to make a difference between heating temperatures (transfer temperatures) of the region e and the regions (a, b, and f) adjacent to the region e fall within a predetermined value (30 degrees in the embodiment). That is, in the heating plate 23 or the heating drum 31, the difference between heating temperatures of adjacent heating portions is made as small as possible to stabilize the temperature in each region. In the embodiment, the heating temperature (transfer temperature) in the region e was decreased from 220 degrees to 210 degrees, whereas the heating time (transfer time) was extended from 190 seconds to 200 seconds, and a correction is made so that the decrease in the heating temperature is compensated by the heating time.

Operation of Thermal Transfer System

Next, with reference to FIGS. 3A, 3B, 4A, 4B, 5A, 5B, and 6 based on the sequence chart of FIG. 2, the operation (control) of the thermal transfer system will be described mainly using the control information generating apparatus 1 and the thermal transfer apparatus 2.

Figure 2:
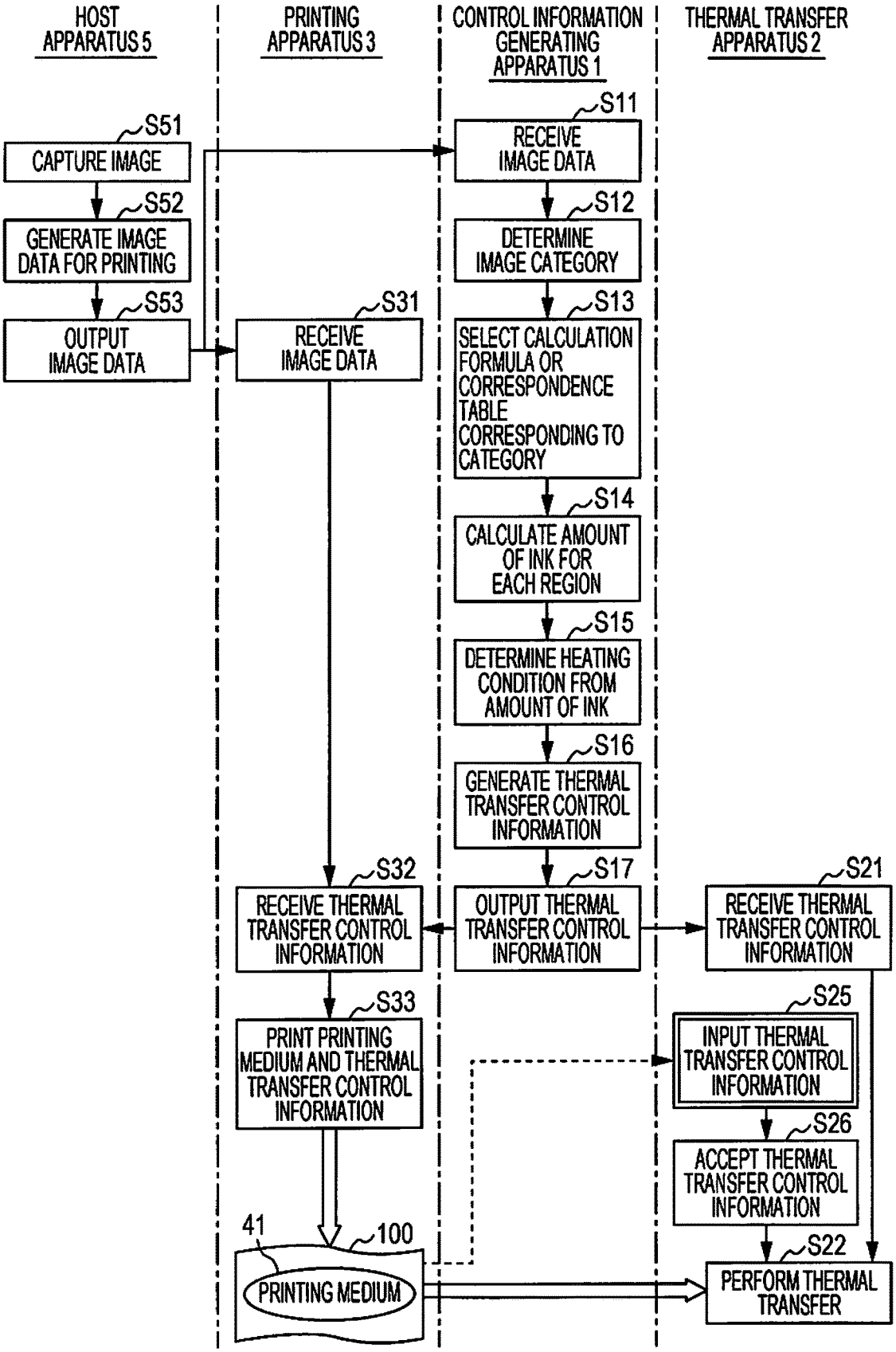
FIG. 2 is a sequence chart for describing operations of a control information generating apparatus.

FIG. 2 shows an example of operations in which the printing apparatus 3 prints the printing medium 41 based on the image data D output from the host apparatus 5, the control information generating apparatus 1 generates the thermal transfer control information CTRL, and the thermal transfer apparatus 2 thermally transfers the printing medium based on the thermal transfer control information CTRL.

As shown in FIG. 2, first, the host apparatus 5 captures and stores an image from the outside (step S51).

Next, the host apparatus 5 selects an image to be printed by thermal transfer from an image stored in advance or an image newly captured from the outside, and generates image data D for printing, which are expressed in ink colors of CMYK and the amount of ink using the LUT or the like (step S52). The image data D for printing is data for printing the printing medium 41 (see FIGS. 4A and 4B).

Subsequently, the host apparatus 5 outputs the generated image data D for printing, to the control information generating apparatus 1 and the printing apparatus 3 (step S53).

The control information generating apparatus 1 receives the image data D for printing transmitted from the host apparatus 5 (step S11).

Next, using the image category detecting portion 11, the control information generating apparatus 1 determines, from the image data D, whether the printing medium 41 is a line image or a solid image (image category determination, step S12).

At this time, the image category detecting portion 11 judges the drawing content of the printing medium 41 for each region corresponding to the regions (a, b, and, . . . , e, f, and, . . . ) of the heating plate 23 or the heating drum 31 of the thermal transfer apparatus 2, and determines an image category. In the example of the printing medium 41, it is determined that the regions (a, and b) are a line image and the regions (e, and f) are a solid image. The image category determination function of the image category detecting portion 11 is realized by a known image automatic recognition correction technique applied to various image processing apparatuses.

In a case where the image category is determined in step S12, the control information generating apparatus 1 selects the line image correspondence table 51 (see FIG. 5A) for a region in which the image category is determined to be a line image, and selects the solid image correspondence table 52 (see FIG. 5B) for a region in which the image category is determined to be a solid image. Alternatively, a calculation formula corresponding to each image category is selected (step S13). Here, details of the line image correspondence table 51 and the solid image correspondence table 52 are proposed as described above.

On the other hand, the calculation formula is, for example, formula 1 shown below.

$$\frac{C \times w(\%) + M \times x(\%) + Y \times y(\%) + K \times z(\%)}{\text{Amount of Dischargeable Ink}} \times (Temp \times \alpha) + Temp\ \beta \quad (1)$$

In formula 1, a first-term calculates the ratio of the amount of ink to be used in each region to the amount of dischargeable ink. The nominator of the first term (C×w(percent)+M×x(percent)+Y×y(percent)+K×z(percent)) with respect to a denominator (an amount of dischargeable ink) indicates that the amount of w percent of cyan (C), x percent of magenta (M), y percent of yellow (Y), and z percent of black (K) was used.

The second term and the third term of the formula 1 are terms indicating the heating temperature, and different values according to the image category. "Temp" in the second term is the prescribed temperature, and a coefficient "α" applied to "Temp" takes different values according to the image category. "Temp β" in the third term is a reference temperature as the base of the heating temperature and takes different values according to the image category. Therefore, in the multiplication of the first term and the second term, a temperature proportional to the amount of ink to be used for printing of the printing medium 41 is obtained in each region, the temperature is added to the reference temperature of the third term, and an appropriate heating temperature is calculated. As described above, in the calculation formula, the heating temperature is obtained as the heating condition according to the image category.

A plurality of calculation formulas according to formula 1 are prepared for each image category and stored in the ROM 20 or the RAM 30 of the control information generating apparatus 1. Values in mathematical formulas including the coefficient "α" may be appropriately rewritten.

Next, the control information generating apparatus 1 calculates the amount of ink to be used for printing for each region (a, b, and, . . . , e, f, and, . . . ) of the printing medium 41 (step S14). At this time, the amount of ink is calculated as the ratio (drawing area/region area) obtained by dividing the drawing area (the area where ink is discharged) by the region area in each region.

In step S14, in a case where the amount of ink is calculated for each region, the control information generating apparatus 1 determines the heating condition based on the amount of ink (step S15). That is, the heating condition is determined from the amount of ink calculated in step S14, using the line image correspondence table 51 or the solid image correspondence table 52 or the formula 1 (calculation formula) selected in step S13.

Here, an example in which the heating condition is determined specifically using the line image correspondence table 51 and the solid image correspondence table 52 will be described. As described above, in the example of the printing medium 41, regions (a and b) are a line image, regions (e and f) are a solid image, and the amount of ink indicates 10 percent for the region a, 30 percent for the region b, 80 percent for the region e, and 60 percent for the region f. Herein, it is considered that the type of the thermal transfer paper 100, on which the printing medium 41 is printed, is the media A.

Therefore, for the region a, the line image correspondence table 51 is used, and the transfer temperature of 180 degrees and the transfer time of 120 seconds are determined from the row with the amount of ink of 10 percent. Similarly, for the region b, a transfer temperature of 180 degrees and a transfer time of 160 seconds are determined. Further, for the region e, the solid image correspondence table 52 is used, and a transfer temperature of 220 degrees and a transfer time of 190 seconds are determined from the row with the amount of ink of 80 percent. Similarly, for the region f, a transfer temperature of 210 degrees and a transfer time of 180 seconds are determined. In this manner, the transfer temperature and the transfer time as heating conditions are determined for each region.

Subsequently, the control information generating apparatus 1 generates the thermal transfer control information CTRL based on the heating condition determined in step S15

(step S16). The thermal transfer control information table 61 shown in FIG. 6 is the generated thermal transfer control information CTRL, and is generated based on the heating conditions determined in the processing of step S12 to step S15. That is, in the thermal transfer control information table 61, regions (a, b, c, and, . . . ) and heating conditions are described in a matrix. Specifically, in the row of the region a, the transfer temperature of 180 degrees and the transfer time of 120 seconds described in the step S15 are written, and in the row of the regions (b, e, and f), the transfer temperature and the transfer time (seconds) described in step S15 are written, similarly to the region a, and thus the thermal transfer control information table 61 as the thermal transfer control information CTRL is generated.

Further, in step S16, the control information generating apparatus 1 verifies a difference between transfer temperatures of adjacent regions and performs a correction processing to make the difference fall within a predetermined value (30 degrees in the embodiment). For example, the thermal transfer control information table 61 is corrected as in the thermal transfer control information table 62 by the thermal transfer control information generation processing in step S16. The content of the correction processing and the correction value may be appropriately changed according to the constitution and function of the thermal transfer apparatus 2.

Upon completion of generation of the thermal transfer control information CTRL, the control information generating apparatus 1 outputs the generated thermal transfer control information CTRL to the thermal transfer apparatus 2 and the printing apparatus 3 via a network (step S17). The presence or absence of output to the printing apparatus 3 may be selected.

The printing apparatus 3 receives the image data D for printing transmitted from the host apparatus 5 in step S53 (step S31). In step S17, the thermal transfer control information CTRL, which has been transmitted from the control information generating apparatus 1, is received (step S32). However, the thermal transfer control information CTRL may not be transmitted according to the setting of the control information generating apparatus 1.

Subsequently, the printing apparatus 3 prints the printing medium 41 on the thermal transfer paper 100 based on the image data D for printing, and in a case where the thermal transfer control information CTRL is received, the thermal transfer control information CTRL is printed as two-dimensional codes (45, 46, and, . . . ) (step S33), and the thermal transfer paper 100, on which the printing medium 41 is printed, is completed (see FIGS. 4A and 4B).

The thermal transfer apparatus 2 receives the thermal transfer control information CTRL from the control information generating apparatus 1 by the controller 25 (step S21). In accordance with the received thermal transfer control information CTRL (thermal transfer control information table 61 or thermal transfer control information table 62), the controller 25 performs heat transfer by heating each region (a, b, e, and f) for the set transfer time at the set transfer temperature (step S22). Since each region of the heating plate 23 or the heating drum 31 of the thermal transfer apparatus 2 may be individually heated by the heating portion, it is possible to individually heat each region for different transfer time (heating time).

On the other hand, in the thermal transfer paper 100 (see FIG. 4B) on which the thermal transfer control information CTRL is printed with two-dimensional codes (45 and 46), the controller 25 reads two-dimensional codes (45 and 46) or a user inputs the thermal transfer control information CTRL from the controller 25 (step S25). As a result, the controller 25 accepts the thermal transfer control information CTRL (step S26), heats each region (a, b, e, and f) for the set transfer time at the set transfer temperature and performs the thermal transfer (step S22).

As described above, in the operation of the thermal transfer system including the control information generating apparatus 1, the thermal transfer apparatus 2, and the printing apparatus 3, the printing medium 41 printed on the thermal transfer paper 100 is transferred to the polyester fiber 120 and printed thereon.

Function and Effect

As described above, since according to the embodiment, thermal transfer conditions of each region are set based on the amount of ink to be used for printing in each region (a, b, and, . . . , e, f, and, . . . ) of the printing medium 41, the printing medium 41 is thermally transferred faithfully to polyester fiber or the like (second medium) which is a recording medium.

Since the correspondence table or calculation formula stored in the storage elements (ROM 20 and RAM 30) of the control information generating apparatus 1 is used at the time of generating the thermal transfer control information CTRL, the heating condition may be quickly derived, and the correspondence table or calculation formula may be rewritten, so that heating conditions may be easily changed. Further, in a case of using the calculation formula, the storage region may be reduced, so that the storage region of the storage elements (ROM 20 and RAM 30) may be saved.

Further, since the correspondence table or calculation formula to be used is switched according to the drawing content of the printing medium 41, more appropriate thermal transfer conditions may be set.

Modification Example

Although the embodiments of the invention have been described above, various modifications are possible within a scope without departing from the substance of the invention, for example, as described below.

Modification Example 1

In the aforementioned embodiment, the control information generating apparatus 1 is described as separate from the thermal transfer apparatus 2 and the printing apparatus 3, but the control information generating apparatus 1 may be configured to be incorporated in the thermal transfer apparatus 2 or the printing apparatus 3. According to this, the thermal transfer system may be miniaturized.

Modification Example 2

In the rotary thermal transfer apparatus 300, the thermal transfer paper 100 and the polyester fiber 120 are transported together with the rotation of the heating drum 31. For that reason, a time (transfer time) during which the thermal transfer paper 100 is heated by the heating drum 31 depends on the rotating speed of the heating drum 31. Therefore, in addition to the heating temperature and the heating time, the transport speed (the rotating speed of the heating drum 31) of the polyester fiber 120 (the second medium) may be included in the heating condition. According to this, in a case where the thermal transfer apparatus 2 is the rotary thermal transfer apparatus 300, the heating time may be managed using the transport speed.

Modification Example 3

In the aforementioned embodiment, the heating condition is determined based on the amount of ink and the type of the thermal transfer paper 100, but in addition to this, the heating condition is determined according to the kind (color and material) of the ink or the kind of the second medium. According to this, the printing medium 41 is thermally transferred more faithfully.

The invention is not limited to the aforementioned embodiments or modification examples and may be realized in various constitutions within a scope without departing from the substance thereof. For example, in order to solve a part or all of the aforementioned problems or to achieve a part or all of the aforementioned effects, the technical features of the embodiments and modification examples may be appropriately replaced or combined. Unless it is described that technical features thereof are essential in this specification, the technical features may be appropriately deleted.

This application claims priority under 35 U.S.C. 119 to Japanese Patent Application No. 2017-116544, filed Jun. 14, 2017. The entire disclosure of Japanese Patent Application No. 2017-116544 is hereby incorporated herein by reference.

What is claimed is:

1. A control information generating method for generating thermal transfer control information for heating a printing medium printed on a first medium based on image data and thermally transferring the printing medium to a second medium, the method comprising:

calculating, from the image data, an amount of ink that is to be used for printing of the printing medium; and generating, based on the amount of ink, the thermal transfer control information in accordance with which the printing medium printed on the first medium based on the image data is heated and thermally transferred to the second medium.

2. The control information generating method according to claim 1, wherein a heating condition for heating the printing medium in a predetermined region is determined corresponding to the amount of ink in the region of the printing medium, and wherein the heating condition is contained in the thermal transfer control information.

3. The control information generating method according to claim 2, wherein the heating condition is determined such that a difference between heating temperatures of adjacent regions falls within a predetermined value.

4. A control information generating apparatus for generating thermal transfer control information for heating a printing medium printed on a first medium based on image data and thermally transferring the printing medium to a second medium, the apparatus comprising:

a thermal transfer control information generating portion that generates the thermal transfer control information based on an amount of ink to be used for printing of the printing medium by using the control information generating method according to claim 3.

5. The control information generating method according to claim 2, wherein the heating condition includes a heating temperature and a heating time for heating the printing medium.

6. The control information generating method according to claim 5, wherein in a case where the printing medium is thermally transferred while the second medium is transported, a transport speed of the second medium is contained in the heating condition.

7. A control information generating apparatus for generating thermal transfer control information for heating a printing medium printed on a first medium based on image data and thermally transferring the printing medium to a second medium, the apparatus comprising:

a thermal transfer control information generating portion that generates the thermal transfer control information based on an amount of ink to be used for printing of the printing medium by using the control information generating method according to claim 5.

8. A control information generating apparatus for generating thermal transfer control information for heating a printing medium printed on a first medium based on image data and thermally transferring the printing medium to a second medium, the apparatus comprising:

a thermal transfer control information generating portion that generates the thermal transfer control information based on an amount of ink to be used for printing of the printing medium by using the control information generating method according to claim 2.

9. The control information generating method according to claim 1, wherein a heating condition is determined based on a correspondence table in which the amount of ink and the heating condition are associated.

10. The control information generating method according to claim 9, wherein the correspondence table is switched according to a drawing content of the printing medium.

11. A control information generating apparatus for generating thermal transfer control information for heating a printing medium printed on a first medium based on image data and thermally transferring the printing medium to a second medium, the apparatus comprising:

a thermal transfer control information generating portion that generates the thermal transfer control information based on an amount of ink to be used for printing of the printing medium by using the control information generating method according to claim 10.

12. A control information generating apparatus for generating thermal transfer control information for heating a printing medium printed on a first medium based on image data and thermally transferring the printing medium to a second medium, the apparatus comprising:

a thermal transfer control information generating portion that generates the thermal transfer control information based on an amount of ink to be used for printing of the printing medium by using the control information generating method according to claim 9.

13. The control information generating method according to claim 1, wherein a heating condition is determined based on a calculation formula for calculating the heating condition from the amount of ink.

14. The control information generating method according to claim 13, wherein the calculation formula is switched according to a drawing content of the printing medium.

15. A control information generating apparatus for generating thermal transfer control information for heating a printing medium printed on a first medium based on image data and thermally transferring the printing medium to a second medium, the apparatus comprising:

a thermal transfer control information generating portion that generates the thermal transfer control information based on an amount of ink to be used for printing of the printing medium by using the control information generating method according to claim 14.

16. A control information generating apparatus for generating thermal transfer control information for heating a printing medium printed on a first medium based on image data and thermally transferring the printing medium to a second medium, the apparatus comprising:

a thermal transfer control information generating portion that generates the thermal transfer control information based on an amount of ink to be used for printing of the printing medium by using the control information generating method according to claim 13.

17. A control information generating apparatus for generating thermal transfer control information for heating a printing medium printed on a first medium based on image data and thermally transferring the printing medium to a second medium, the apparatus comprising:

a thermal transfer control information generating portion that generates the thermal transfer control information based on an amount of ink to be used for printing of the printing medium by using the control information generating method according to claim 1.

18. The control information generating apparatus according to claim 17, wherein the thermal transfer control information is output to a printing apparatus that prints the printing medium.

19. A thermal transfer apparatus which heats a printing medium printed on a first medium based on image data and thermally transfers the printing medium to a second medium, the apparatus comprising:

a plurality of heating portions that heat the printing medium, wherein the plurality of heating portions are individually heated based on thermal transfer control information determined according to an amount of ink, to transfer, to the second medium, a predetermined region of the printing medium which is printed on the first medium by the ink based on a predetermined image data, and the amount of the ink is an ink amount calculated from the predetermined image data based on which the predetermined region of the printing medium is printed on the first medium.

20. The thermal transfer apparatus according to claim 19, wherein the plurality of heating portions are individually heated based on the thermal transfer control information determined according to the amount of ink that is calculated by dividing, by an area of a predetermined region of the first medium, a drawing area on which the ink is to be discharged in the predetermined region of the first medium, to obtain a ratio of the drawing area to the area of the predetermined region of the first medium as the amount of ink.

21. The thermal transfer apparatus according to claim 19, wherein the plurality of heating portions are configured to heat the printing medium independently of printing of the printing medium on the first medium.

* * * * *